United States Patent [19]

Goodenough et al.

[11] 3,978,859

[45] Sept. 7, 1976

[54] CLOSURE MEMBER FOR PIERCEABLE ACCESS PORTS

[75] Inventors: John S. Goodenough, Berkeley; Wendell R. Parker, Moraga, both of Calif.

[73] Assignee: Cutter Laboratories, Inc., Berkeley, Calif.

[22] Filed: Jan. 23, 1975

[21] Appl. No.: 543,466

[52] U.S. Cl. ..... 128/272; 128/214 D; 215/249

[51] Int. Cl.[2] ..... A61J 1/00

[58] Field of Search..... 128/272, 214 D, DIG. 24; 215/247, 249, DIG. 3, 250, 253; 401/132–134; 220/265, 266, 276, 27; 150/.5

[56] References Cited

UNITED STATES PATENTS

| | | | |
|---|---|---|---|
| 3,081,899 | 3/1963 | Parker | 220/276 |
| 3,424,218 | 1/1969 | Vanderbur, Jr. et al. | 128/272 |
| 3,905,368 | 9/1975 | Lewis et al. | 128/272 |

*Primary Examiner*—Robert W. Michell
*Assistant Examiner*—Henry S. Layton
*Attorney, Agent, or Firm*—Gardiner, Sixbey, Bradford & Carlson

[57] ABSTRACT

A closure member for pierceable access ports of flexible containers of the type adapted for effective safe storage and use of parenteral fluids and similar sterile solutions, the access port having a pierceable access closure diaphragm, wherein the closure member includes a base portion in sealed engagement over the neck of the access port on the container, with a rigidifying and strengthening portion or an insert in sealed engagement therebetween, and a free-standing portion extending from the base portion and having a sealed end, the free-standing portion being connected to the base portion by a fragible thinned material section adapted to be ruptured to permit the free-standing portion to be removed, thereby providing access to the pierceable diaphragm for insertion therethrough of a parenteral solution administration spike.

23 Claims, 7 Drawing Figures

CLOSURE MEMBER FOR PIERCEABLE ACCESS PORTS

BACKGROUND OF THE INVENTION

For effective safe storage and use of parenteral fluids and similar sterile solutions, it is necessary that such fluids be stored in sterile, tamper-proof containers provided with means to facilitate withdrawal of the fluid without a substantial sacrifice of sterility. Some containers or bags are formed of flexible plastic in such a manner as to enclose parenteral fluid or other sterile fluid. The container is later entered through a sealed port structure or the like in order to dispense measured amounts of the contents therefrom. As the liquid contents from such flexible sealed plastic containers are dispensed, the container collapses, and therefore no venting of the container with air which might carry contaminants is required. In some previously known constructions, the sealed bag containers have been provided with entry or exit ports through which an entry spike or needle could be inserted and retained in tight sealed relationship therewith, the port frequently consisting of a tubular needle supporting structure secured at one end or in some cases on a wall of the bag by a flange or similar structural element. In some constructions, the portion of the bag enclosed by the tubular element served as a pierceable diaphragm. A resilient plug would then be fitted into the tubular element to hold the needle inserted through the plug in the side of the bag.

Recently, interest has developed in the use of blow molded flexible containers as containers for sterile solutions. Such containers may be blow-molded to provide a neck end which is sealed, and before the sealing of the neck end, sterile solution may be introduced into the container.

In one such container as shown in U.S. Pat. No. 3,746,001, a tubular gripping sleeve of semi-rigid plastic is positioned about the closed end of the tubular neck so as to provide an internal pierceable diaphragm. The inside diameter of the sleeve which extends beyond the tubular neck is the same as the inside diameter of the tubular neck and is of a size which will provide sealing engagement of an entry spike fitted into the sleeve. The end of the sleeve is either capped by a plug or by a removable tab or cover for maintaining sterility prior to use. However, there is no guarantee of sterility with such covers since they can be removed and reinstalled without an indication of their having been tampered with. Another drawback to such a closure system is that the entry spike is difficult to slide through the plastic sleeve and tubular neck unless it has been lubricated.

Another pierceable access port assembly for a flexible sterile solution container adapted for easy securement to the container is shown in co-pending application Ser. No. 443,011, filed Feb. 15, 1974, and titled Pierceable Access Port Assembly, and assigned to a common assignee herewith. The present invention constitutes an improvement in simplicity of construction and use over those shown in previous known constructions.

BRIEF DESCRIPTION OF THE INVENTION

The present invention provides a closure member for pierceable access ports of flexible containers of the type adapted for effective safe storage and use of parenteral fluids and similar sterile solutions in the nature of a tamper-proof sterility cover for securing to an access port of the flexible container and which is sealed with a pierceable diaphragm subsequent to filling of the container. The closure member includes a base portion which is in sealed engagement around the neck or access port of the container and which either includes a thickened rigidifying portion or a rigidifying insert in sealed engagement between the closure member and the neck of the container for at least that portion of the closure member which extends beyond the pierceable diaphragm. The closure member further includes an upstanding member or portion extending from the base portion, with the upstanding member being connected to the base portion by a frangible thinned material section adapted to be ruptured whereby the upstanding portion can be removed by tearing, to thereby provide access to the pierceable diaphragm for insertion therethrough of a parenteral solution administration spike, the spike being sealingly engaged by an inner skirt portion of the closure member.

Additional objects and advantages of the present invention will be more readily apparent from the following detailed description of embodiments thereof when taken together with the accompanying drawings in which.

Figure 1:
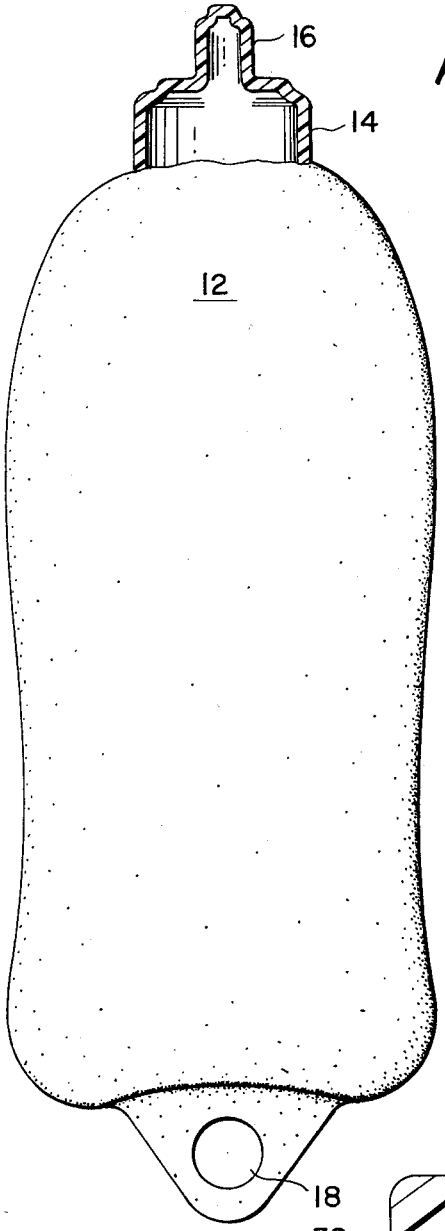
FIG. 1 is a partially sectioned view illustrating a conventional blow-molded flexible container for sterile solutions having a pierceable closure diaphragm over an access port portion.

Referring now to the drawings, FIG. 1 discloses a flexible plastic container 10 adapted for use in storing and dispensing sterile solutions such as parenteral solutions, blood plasma, blood, etc. The container 10 consists of a collapsible container having a closed body member 12 formed by a blow-molding process to any shape employed for such containers. The body member, during the blow molding process, is provided with a neck portion 14 and a closed projection or access port generally designated 16. A hanger portion 18 is provided at the end opposite the neck 14 as is standard. The container 10 is formed of plastic material which is compatible with the particular sterile solution to be contained. For example, with parenteral solutions, the container may be formed of polyvinyl chloride (PVC).

Figure 2:
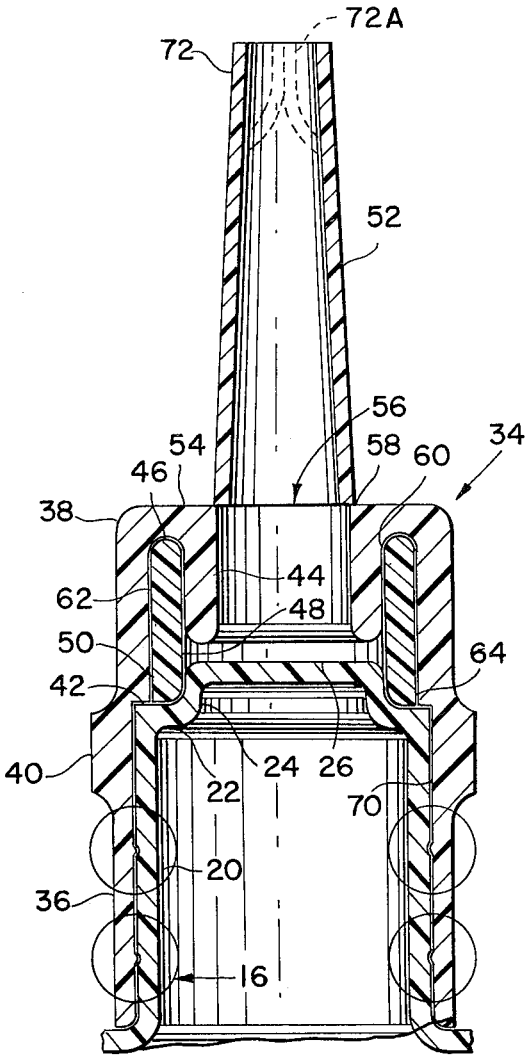
FIG. 2 is an enlarged sectional view of the closure member of the invention as applied and connected to a flexible container of the type shown in FIG. 1.
Figure 3:
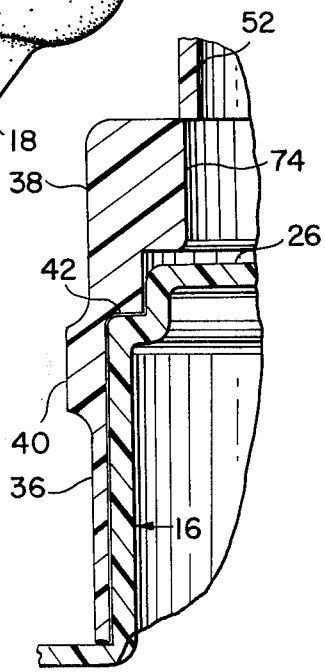
FIG. 3 is a fragmentary sectional view of a modified construction.

During formation of a blow molded container, such as shown at container 10, it is desirable to completely close the container and to accomplish this, the container body and neck are first formed, the sterile solution is introduced into the container, and then the neck is formed into a closed access port. One form of access port for the neck 14 is illustrated in FIGS. 1–3 wherein the access port indicated generally at 16 includes an upwardly directed wall 20, an inwardly directed flange portion 22, an upstanding side wall portion 24 and a crown closure wall 26 which constitutes a pierceable diaphragm as will be hereinafter described. This closed projection or port constitutes an access port to container 10 and in use an administration spike of a parenteral solution unit is inserted through the pierceable diaphragm 26 to provide access to the solution in the container.

It is understood that more than one access port may be formed on the container if desired, e.g., a second access port similar to closure or access port 16 may project from neck 14, for the purpose of introducing additive solutions into the container to mix with a parenteral solution therein.

The closure member adapted for attachment to access ports of containers and which provides a tamperproof sterility cover for the port, and also provides means for access to the pierceable diaphragm closing the port, is generally designated 34, the details of one embodiment thereof being disclosed in FIG. 2. The closure member is preferably of the same material as container 10 and molded to the appropriate configuration and dimensions. Polyvinyl chloride, for example, lends itself to formation of the molded closure member and can be readily sealed to a PVC container. Preferably, closure member 34 is in a form which renders it somewhat soft or pliable and also provides a smooth surface which has a lower coefficient of friction than the tubular access port to which it is secured. Some of the pigmented polyvinyl chlorides possess this desirable property, as for example, white PVC manufactured by the Maclin Company under the designation Maclin VM 0365.

As shown in the drawing, the closure member 34 includes a lower neck or skirt portion 36 of tubular configuration adapted to be juxtaposed on the exterior of the tubular access port 16 of the container in a close fitting manner and, as will appear hereinafter, be sealed thereto. Formed as a continuation of lower skirt portion 36 is an upper cap portion 38. A bead 40 is provided for strength and also to facilitate gripping and holding of the access port.

Upper cap portion 38 includes an inturned ledge or flange 42 adapted for coacting engagement on inwardly directed flange portion 22 of port 16. The upper cap portion 38 also includes, as shown in the embodiment of FIG. 2, a downwardly depending tubular skirt 44 in spaced relationship from the innerwall of the cap portion, and forming therebetween a groove 46. As shown, skirt 44 has such a length whereby it terminates short of the top of pierceable diaphragm 26 when in mounted position. The inner surface of skirt 44 sealingly engages an administration set spike which is intended to pierce diaphragm 26 for gaining access to the contents of container 10. A rigidifying tube 48 is seated in groove 46 and extends therefrom with the end 50 engaged between the innerwall of upper cap portion 38 and the exterior wall of upstanding side wall portion 24 of port 16. The lower end 50 of tube 48 engages with the in turned ledge or flange 42 of upper cap portion 38. Rigidifying tube 48 is preferably stiffer than the material which constitutes closure member 34 and lends stability to upper cap portion 38. Tube 48 is preferably made of the same material as the container or the other portions of closure member 34 so that an effective sealing together of all parts can be made.

An upstanding member 52, which, as shown in FIG. 2, can be of frusto-conical shape, is connected to the upper surface or face 54 of upper cap portion 38 surrounding central opening or hole 56 therein. The connection is made by means of a frangible or rupturable thin section of the material indicated at 58. As will be seen, this connection is in the nature of a peripheral connecting line of material between the outer circumferential wall of the base of member 52 and the peripheral edge of the opening 56.

The closure is sealed with respect to projection 16 by effecting a seal at 60 between skirt 44 and tube 48, and also between tube 48 and the inner surface of the upper cap 38 as at 62. Tube 48 is further sealed along the contacting surfaces in the region designated 64 between the base of rigidifying tube 48 and the end 50 thereof with the exterior surface of wall 24 annd flange 42.

Figure 4:
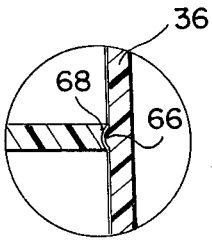
FIG. 4 is a fragmentary enlarged view of a portion of the construction represented by the circle in FIG. 2 of enhanced attachment means for the closure member.

The attachment and sealing is further enhanced by means as shown in detail in FIG. 4. A peripheral bead 66 is provided, in the manufacture thereof, on the interior surface of skirt 36 which is engageable within a peripheral groove 68 in the external surface of wall 20. The mating surfaces of the wall 20 and skirt 36 are further sealed one to another along the entire area generally designated 70.

The upper or outer end 72 of tube 52 is sealed flat, as shown in broken lines at 72A, after tube 48 is sealed to the end of projection 16 and the closure member 34 is sealed to tube 48 and projection 16. To expose the pierceable diaphragm 26, the closure member is grasped in the region of the rigidifying tube 48 and the sealed end of tube 52 is pulled which ruptures the frangible thin section 58 and this allows the end tubular gripping portion to be removed. The pierceable diaphragm 26 which is then exposed is now pierced with a hollow spike of an administration set. The inner surface of skirt portion 44 of the closure member 34 firmly and sealingly engages the rear portion of the spike. The tubular insert or rigidifying tube 48 not only adds greater rigidity to the closure member so that the port can be more readily grasped and the spike retained better, but also provides strength to the closure member portion adjacent the ruptureable thin section 58 which permits tube 52 to be more easily removed.

A modification of the closure is shown in FIG. 3 wherein like parts are designated with like reference characters. In this embodiment, however, the groove 46 and depending skirt 44 are eliminated and in lieu thereof the wall of the closure is thickened as indicated at 74. Some plastic materials, however, do not respond well to being molded with great variations in wall thickness and this drawback is eliminated in the structure shown in FIG. 2.

Figure 5:
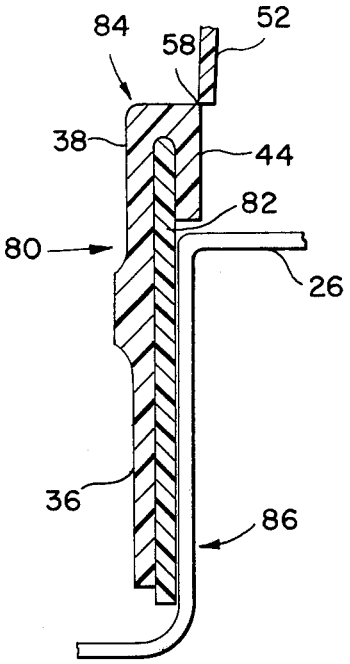
FIG. 5 is a fragmentary sectional view of still another modified construction.

Another embodiment of the closure is illustrated generally as 80 in FIG. 5 wherein the rigidifying tube 82 encompasses most of the length of an access port 85 which has no dimensionally smaller projection at its closed end. In this embodiment, the closure member 84 is sealed directly to substantially all exposed surfaces of tube 82 and does not come into contact with surfaces of port 86.

Figure 6:
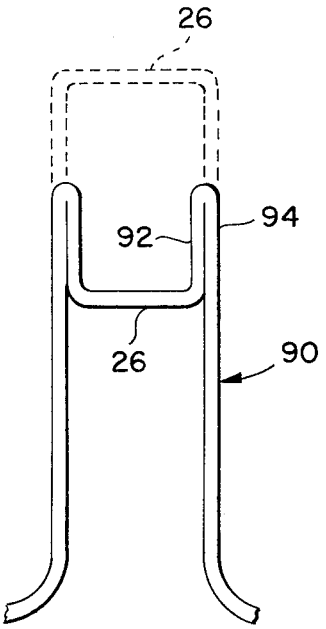
FIG. 6 is a fragmentary sectional view of a container embodiment provided with a rigidifying portion as an integral part of an access port portion.
Figure 7:
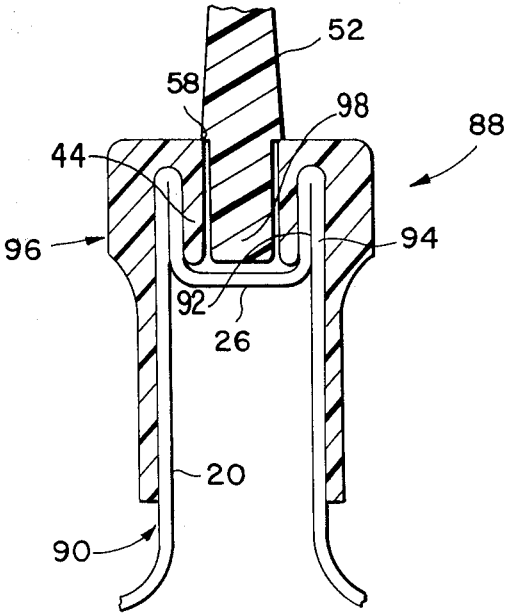
FIG. 7 is a fragmentary sectional view of a closure member sealed to the access port of FIG. 6.

FIG. 7 shows still another modification of the closure of this invention generally indicated at 88. In this embodiment, the rigidifying portion is supplied by the walls of the closed end of an access port 90 as shown in FIG. 6. Access port 90 as originally formed has the shape represented by dotted lines. By pushing in one surface 26 with a mandrel, while containing the sides with clamping jaws, the two layers 92, 94 are juxtaposed and may then be sealed, preferably by heat, to form a rigidifying portion which at the same time supports pierceable diaphragm 26. Closure member 96 is then sealed to the double layer 92, 94 comprising in effect the rigidifying member, as well as to lower skirt or wall 20 of port 90.

The upstanding member 52 may be a solid member as illustrated in FIG. 7 instead of hollow as shown in FIG. 2. This solid member includes a plug section 98 which extends below the frangible section 58 within the skirt 44 and terminates above the closure wall 26. The plug section is spaced from the skirt 44 so that the member 52 may be moved sideways to rupture the frangible section.

While the closure member has been shown and described in detail with reference to a single port flexible container, FIGS. 1 through 7, the invention is applicable to containers having two or more access ports.

While preferred embodiments have been shown and described herein, manifestly minor changes in details of construction can be effected without departing from the spirit and scope of the invention as defined in and limited solely by the appended claims.

I claim:

1. In combination, a container for storage and administrationn of parenteral liquids and the like, having a pierceable access port for insertion therethrough of a parenteral administration spike, and a tamper proof protective closure member mounted over and surrounding said access port, wherein:

a. said access port includes:
   i. an upstanding wall portion extending from the body of said container; and
   ii. a pierceable diaphragm constituting a top closure on said wall portion;
b. said tamper proof closure member including:
   i. a base portion engaged around and sealed to said upstanding wall portion of said access port; and
   ii. an upwardly extending closed member integrally connected with said base portion;
c. frangible means for forming a bacteria proof seal between said upwardly extending closed member and said base portion, said frangible means including a frangible material section and being rupturable to remove at least an upper portion of said upwardly extending member to expose said pierceable diaphragm for insertion therethrough of said spike, said frangible material section having a radial cross sectional extent substantially less than the outer radial cross sectional extent of said base portion relative to the longitudinal axis of said base portion.

2. In the combination of claim 1, said container being formed of flexible material and said closure material being formed of a resilient material.

3. In the combination of claim 2, said container and said closure member consisting of a thermoplastic material.

4. In the combination of claim 3, wherein the frangible material section comprises a thinned area of the thermoplastic material joining and integrating said upwardly extending member with and on said base portion.

5. In the combination of claim 1, said frangible material section comprising a thinned area of material joining and integrating said upwardly extending member with and on said base portion.

6. In the combination of claim 1, wherein said frangible means is co-axial with the base so that force may be applied to said upwardly extending closed member in any direction away from said container to fracture said frangible means.

7. In combination, a container for storage and administration of parenteral liquids and the like, having a pierceable access port for insertion therethrough of a parenteral administration spike, and a tamper proof protective closure member mounted over and surrounding said access port, wherein:

a. said access port includes:
   i. an upstanding wall portion extending from the body of said container; and
   ii. a pierceable diaphragm constituting a top closure on said wall portion;
b. said tamper proof closure member including:
   i. a base portion engaged around and sealed to said upstanding wall portion of said access port; and
   ii. an upwardly extending closed member integrally connected with said base portion and having a frangible means;
c. said frangible means constituting a frangible material section and being rupturable to remove at least an upper portion of said upwardly extending member to expose said pierceable diaphragm for insertion therethrough of said spike;
d. said container further including a closed projection port on said upstanding wall portion and having said pierceable diaphragm sealing the top of said port, said projection including an inturned flange at the top of said wall portion, said base portion of said closure member including an internal ledge adapted for engagement with said inturned flange, and mating surfaces of said closure member and said projection port being sealed together.

8. In the combination of claim 7, said base portion of said closure member including a downwardly depending internal skirt spaced from the interior surface of said base portion and defining therebetween a groove, a rigidifying tube inserted in said groove and sealed thereto, the lower end of said rigidifying tube being in abutting engagement with said inwardly directed flange on said closed projection and being sealed thereto, and to the interior and exterior juxtaposed mating surfaces of said base and an upstanding side wall portion of said projection port.

9. In the combination of claim 8, said closure member including a depending skirt engaged over said upstanding wall portion, said depending skirt having an inner peripheral bead, said upstanding wall portion having an external peripheral groove, said bead and said groove mating, and the respective interior and exterior surfaces of said skirt and said upstanding wall portion being sealed one to another.

10. A tamper proof closure member for a container for storage and administration of parenteral liquids and the like having an upstanding wall portion connected with and extending from the container, the upstanding wall portion including a pierceable top closure for hermetically closing the top of the upstanding wall portion, comprising:

a. a base means for receiving the upstanding wall portion, said base means including:
   i. an upper wall;

a skirt portion means integrally connected to and extending from said upper wall for both receiving and sealingly engaging around substantially all of the exterior area of the upstanding wall portion and for providing a first finger grip surface, said skirt portion means including a pliable material for enhancing the strength of the frictional connection between the interior surface of said skirt portion means and the exterior surface of the upstanding wall portion by transmitting finger pressure applied to and around the first grip surface from said first grip surface to the interior surface of the skirt portion means which frictionally engages the exterior surface of the upstanding wall portion means; and b. a closed upwardly extending member including a second grip surface; and c. frangible means for connecting said base means to said upwardly extending member and for forming a bacteria-proof seal between said base means and said upwardly extending member such that the tearing force transmitted by said upwardly extending member when said second grip surface is subjected to sufficient force serves to fracture said frangible means and expose sufficient area of said pierceable diaphragm to allow insertion of a spike into said pierceable diaphragm.

11. A tamper proof closure member as claimed in claim 10, said skirt portion means including an internal rigidifying means having a thickened wall portion of said skirt portion extending between said upper wall of said base means and said top closure of said upstanding wall portion means.

12. A tamper proof closure member as claimed in claim 11, said internal rigidifying means comprising a tube within and sealed to said base means.

13. A tamper proof closure member as claimed in claim 10, wherein said frangible means comprises a thin frangible section of material contained within said upper wall of said base means.

14. A tamper proof closure member as claimed in claim 10, said skirt portion means having an internal rigidifying means comprising a thickened wall portion of said base, and an opening in said upper wall for sealing insertion of said spike.

15. A tamper proof closure member as claimed in claim 14, said internal rigidifying means comprising a tube within and sealed to said base means.

16. A tamper proof closure member for a container having a pierceable closed entry port comprising:

a. a base portion engaged and sealed to and covering said closed entry port;

b. an upwardly extending closed end member connected with said base portion, said upwardly extending closed end member having a radial cross-sectional extent substantially less than the outer radial cross-sectional extent of said base portion relative to the longitudinal axis of said base portion; and c. frangible means in said closed end member for connecting said upwardly extending member to said base means and for forming a bacteria proof seal between said upwardly extending member and said base means, said frangible means also being fracturable by tearing said upwardly extending closed end member in any direction away from said container to permit removal of at least a portion of said closed end member to expose the entry port.

17. A closure member as claimed in claim 16 wherein said frangible means comprises a circumferential line of thinned material for connecting said upwardly extending closed end member with said base portion.

18. A closure member as claimed in claim 16, said frangible means being at the point of joinder of said base portion and said upwardly extending closed end member whereby said closed end member is separable from said base portion by the fracturing of said frangible means.

19. A closure member as claimed in claim 16, said frangible means consisting of an area of thinned material comprising said upwardly extending closed end member.

20. A tamper proof closure member for a container for storage and administration of parenteral liquids and the like having a pierceable access port for insertion therethrough of a parenteral administration spike, comprising:

a base having a portion engaged and sealed to said access port, said base including internal rigidifying means for said base and being adapted for sealingly engaging an administration spike inserted therethrough and piercing said access port, said internal rigidifying means being constituted by an internal closed end of said access port forming a sealed double wall portion with a pierceable diaphragm therein, said base having spaced internal and external skirts thereon, said skirts being sealingly engaged and contacted with the internal and external surfaces of said double wall portion.

21. A tamper proof closure member as claimed in claim 20, including a hollow sealed outer end member integrally connected to said base, the connection thereof constituting a thin frangible section of material of said hollow member.

22. A tamper proof container closure member for storage and administration of parenteral liquids and the like having a pierceable access port for insertion therethrough of a parenteral administration spike, comprising:

a base having a portion engaged and sealed to said access port; said base including internal rigidifying means for said base and being adapted for sealingly engaging an administration spike inserted therethrough and piercing said access port; said access port including a closed end projected member on said container, said base having spaced internal and external skirts thereon, said rigidifying means comprising a rigidifying tube surrounding said projected member and extending above said closed end, said tube being sealingly engaged and contacted respectively with the internal and external surfaces of said skirts, said internal skirt terminating above and being spaced from said closed end.

23. A tamper proof closure member as claimed in claim 22, including a hollow sealed outer end member integrally connected to said base, the connection thereof constituting a thin frangible section of material of said hollow member.

* * * * *